US007411160B2

(12) United States Patent
Duncan et al.

(10) Patent No.: US 7,411,160 B2
(45) Date of Patent: Aug. 12, 2008

(54) AIRFLOW SYSTEM FOR A CONVECTION OVEN

(75) Inventors: Thu-Ha Duncan, Cleveland, TN (US); Christopher A. Larsen, Dorchester, MA (US); Steven M. Swayne, Chattanooga, TN (US); Robert Z. Whipple, Jr., Louden, TN (US)

(73) Assignee: Whirlpool Corporation, Benton Harbor, MI (US)

( * ) Notice: Subject to any disclaimer, the term of this patent is extended or adjusted under 35 U.S.C. 154(b) by 572 days.

(21) Appl. No.: 11/184,849

(22) Filed: Jul. 20, 2005

(65) Prior Publication Data

US 2006/0272632 A1 Dec. 7, 2006

Related U.S. Application Data

(60) Provisional application No. 60/686,051, filed on Jun. 1, 2005.

(51) Int. Cl.
*F27D 7/04* (2006.01)
*F27D 11/02* (2006.01)
*A21B 1/26* (2006.01)

(52) U.S. Cl. ..... 219/400; 99/476; 219/409; 219/410; 126/21 A

(58) Field of Classification Search ..... None
See application file for complete search history.

(56) References Cited

U.S. PATENT DOCUMENTS 3,462,583 A 8/1969 Holtkamp
3,465,124 A 9/1969 Sauer
3,470,353 A 9/1969 Holtkamp
3,501,620 A 3/1970 Sauer
3,514,576 A 5/1970 Hilton et al.
3,828,760 A 8/1974 Farber et al.
4,071,738 A 1/1978 Jenn et al.
4,071,739 A 1/1978 Jenn et al.
4,336,443 A 6/1982 Benedetto
4,357,522 A * 11/1982 Husslein et al. ..... 219/400
4,437,396 A 3/1984 Plattner et al.
4,484,063 A 11/1984 Whittenburg et al.
4,498,453 A 2/1985 Ueda (Continued)

FOREIGN PATENT DOCUMENTS

EP 733862 A2 * 9/1996

(Continued)

*Primary Examiner*—Joseph M Pelham
(74) *Attorney, Agent, or Firm*—John Morrison; Michael D. Lafrenz

(57) ABSTRACT

A convection cooking appliance includes a convection fan for establishing a convection airflow which is heated by a heating element including first and second sections that are symmetrically disposed about the convection fan substantially parallel to and downstream of the convection fan. Each of the first and second sections is formed so as to include at least three lobes and four 180° turns, while establishing a thin profile heating element. A convection fan cover extends across the convection fan and includes a main body portion having an outlet portion for directing the convection airflow into a cooking chamber of the appliance. The outlet portion includes an angled louver and a trip edge portion. The angled louver and trip edge portion cooperate to alter a direction of the convection airflow from being substantially parallel to the main body portion to being substantially perpendicular the main body portion.

17 Claims, 4 Drawing Sheets

U.S. PATENT DOCUMENTS

| | | | | |
|---|---|---|---|---|
| 4,535,226 | A | 8/1985 | Logel et al. | |
| 4,585,923 | A * | 4/1986 | Binder | 219/400 |
| 4,722,683 | A | 2/1988 | Royer | |
| 4,869,155 | A | 9/1989 | Grieve | |
| 4,892,030 | A | 1/1990 | Grieve | |
| 5,485,780 | A | 1/1996 | Koether et al. | |
| 5,695,668 | A | 12/1997 | Boddy | |
| 6,444,955 | B1 | 9/2002 | Loveless | |
| 2004/0123858 | A1 | 7/2004 | McFadden | |
| 2006/0049183 | A1 * | 3/2006 | Eke et al. | 219/681 |

FOREIGN PATENT DOCUMENTS

| | | |
|---|---|---|
| EP | 833110 | 7/1998 |
| GB | 2054833 | 2/1981 |
| JP | 358200935 | 11/1983 |

* cited by examiner

AIRFLOW SYSTEM FOR A CONVECTION OVEN

CROSS-REFERENCE TO RELATED APPLICATION

The present application claims the benefit of U.S. Provisional Patent Application Ser. No. 60/686,051 entitled, Airflow System For a Convection Oven" filed Jun. 1, 2005.

BACKGROUND OF THE INVENTION

1. Field of the Invention

The present invention pertains to the art of cooking appliances, and more particularly, to an airflow system for a cooking appliance employing convection heating techniques.

2. Discussion of the Prior Art

Cooking appliances that cook a food item through a forced-air convection airflow circulated in an oven cavity are known. Forced-air convection systems are incorporated into a wide array of cooking appliances, examples of which include single and double wall ovens, as well as slide-in and free standing ranges. Of the many design considerations that must be accounted for in forced air cooking systems, providing adequate heating to the convection airflow is perhaps one of the most important.

In order to perform a cooking operation, forced air convection systems circulate a heated or convection airflow about a cooking chamber portion of the appliance. Convection ovens typically employ one of three types of air circulation arrangements for heating the convection airflow. The first type of air circulation arrangement, passive circulation, takes advantage of naturally rising convection currents within the oven cavity. Passive circulation has no ability to control or otherwise manage the convection airflow. The second type of air circulation arrangement employs an unheated blower that forces air to circulate in the oven cavity. That is, the blower and heat source are separated in the appliance. Because the blower and heat source are separated, this arrangement provides limited control over air temperature distribution. The third type of air circulation arrangement forces air into the oven cavity after being heated by a heating element positioned proximate to the blower. The third type of arrangement is generally considered to provide the greatest heat transfer to the convection airflow.

In order to ensure a maximum heat transfer, the heating element is typically positioned about the blower in a series of stacked coils. That is, the coiled heating element is wrapped to form two or more spiraling, adjacent sections arranged about the blower. This construction creates a wall that covers roughly ⅔ of the airflow area. While effective at exposing the airflow to a heat source, the stacked coils actually create a significant airflow restriction. That is, the wall, while transferring heat to the airflow, simultaneously reducing the airflow from circulating about the oven cavity efficiently.

Based on the above, there still exists a need for an enhanced airflow arrangement in a convection oven. More specifically, there exists a need for an airflow arrangement that not only provides for maximum heat transfer, but significantly reduces any restrictions that may otherwise impede airflow circulation.

SUMMARY OF THE INVENTION

The present invention is directed to an airflow system for a cooking appliance that employs convection cooking techniques. The oven includes an oven cavity having top, bottom, rear and opposing side walls that collectively define a cooking chamber. A door is mounted for movement relative to the oven cavity for selectively closing the cooking chamber. In accordance with the invention, the oven includes a convection fan for establishing a convection airflow in the cooking chamber. The convection airflow is heated by a heating element arranged about the convection fan. In accordance with the most preferred form of the invention, the heating element includes first and second sections that are symmetrically disposed about the convection fan, while being substantially parallel to and downstream of the convection airflow. Most preferably, each of the first and second sections are formed so as to include at least three lobes and four 180° turns, while establishing a thin profile heating unit.

In further accordance with the most preferred form of the invention, the appliance includes a convection fan cover. In a preferred embodiment, the convection fan cover includes a main body portion having an inlet portion for receiving the convection airflow from the cooking chamber and an outlet portion for directing the convection airflow back into the cooking chamber. Preferably, the inlet portion is juxtaposed to the convection fan and formed with a plurality of apertures that extend radially outward. The outlet portion includes an angled louver and a trip edge portion. The angled louver and trip edge portion cooperate to alter a direction of the convection airflow from being substantially parallel to the main body portion to being substantially perpendicular the main body portion.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
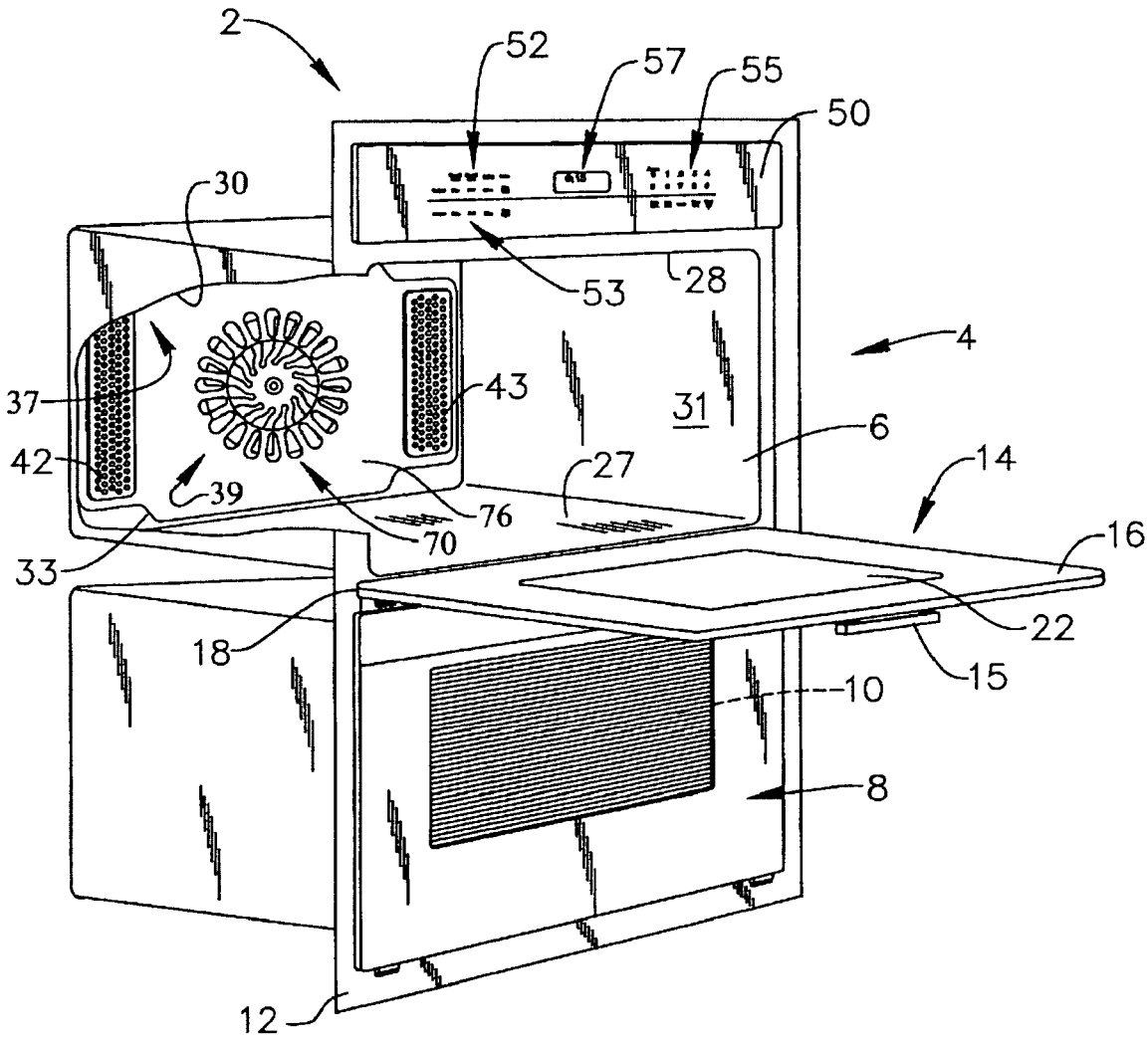
FIG. 1 is a upper left cut-away perspective view of a cooking appliance, shown in the form of a double wall oven, incorporating an airflow system constructed in accordance with the present invention.

With initial reference to FIG. 1, a cooking appliance constructed in accordance with the present invention is generally indicated at 2. Although the form of cooking appliance 2 in accordance with the present invention can vary, the invention is shown in connection with cooking appliance 2 depicted as a wall oven. More specifically, in the embodiment shown, cooking appliance 2 constitutes a dual oven wall unit including an upper oven 4 having upper cooking chamber 6 and a lower oven 8 having a lower cooking chamber 10. As shown, cooking appliance 2 includes an outer trim piece 12 that enables oven 2 to blend into adjacent structure, such as kitchen cabinetry (not shown).

In a manner known in the art, a door assembly 14 is provided to selectively provide access to upper cooking chamber 6. As shown, door assembly 14 includes a handle 15 at an upper portion 16 thereof. Door assembly 14 is adapted to pivot at a lower portion 18 to enable selective access to within upper cooking chamber 6. In a manner also known in the art, door 14 is provided with a transparent zone or window 22 to allow a consumer to view the contents of upper cooking chamber 6 when door 14 is closed.

As best seen in FIG. 1, upper cooking chamber 6 is defined by a bottom wall 27, a top wall 28, opposing side walls 30 and 31, and a rear wall 33. Bottom wall 27 is preferably constituted by a flat, smooth surface designed to improve the overall cleanability, serviceability and reflective qualities of upper cooking chamber 6. In the embodiment shown, arranged on rear wall 33 is a convection fan assembly 37 which, in a manner that will be discussed more fully below, circulates a heated airflow in upper cooking chamber 6. Briefly, heated air is drawn in through a central region 39 and thereafter re-introduced into upper cooking chamber 6 through vents 42 and 43 arranged on either side of fan assembly 37. As indicated above, although cooking appliance 2 is depicted as a wall oven, it should be understood that the present invention is not limited to this model type and can be incorporated into various types of oven configurations, e.g., cabinet mounted ovens, as well as slide-in and free standing ranges.

Further shown in FIG. 1, cooking appliance 2 includes an upper control panel 50 incorporating first and second sets of oven control buttons 52 and 53. Control buttons 52 and 53, in combination with a numeric pad 55 and a display 57, enable a user to establish particular cooking operations for upper and lower ovens 4 and 8 respectively. Since the general programming and operation of cooking appliance 2 is known in the art and does not form part of the present invention, these features will not be discussed further here. Instead, the present invention is particularly directed to an airflow system 70 incorporated into fan assembly 37 as will be detailed more fully below.

Figure 2:
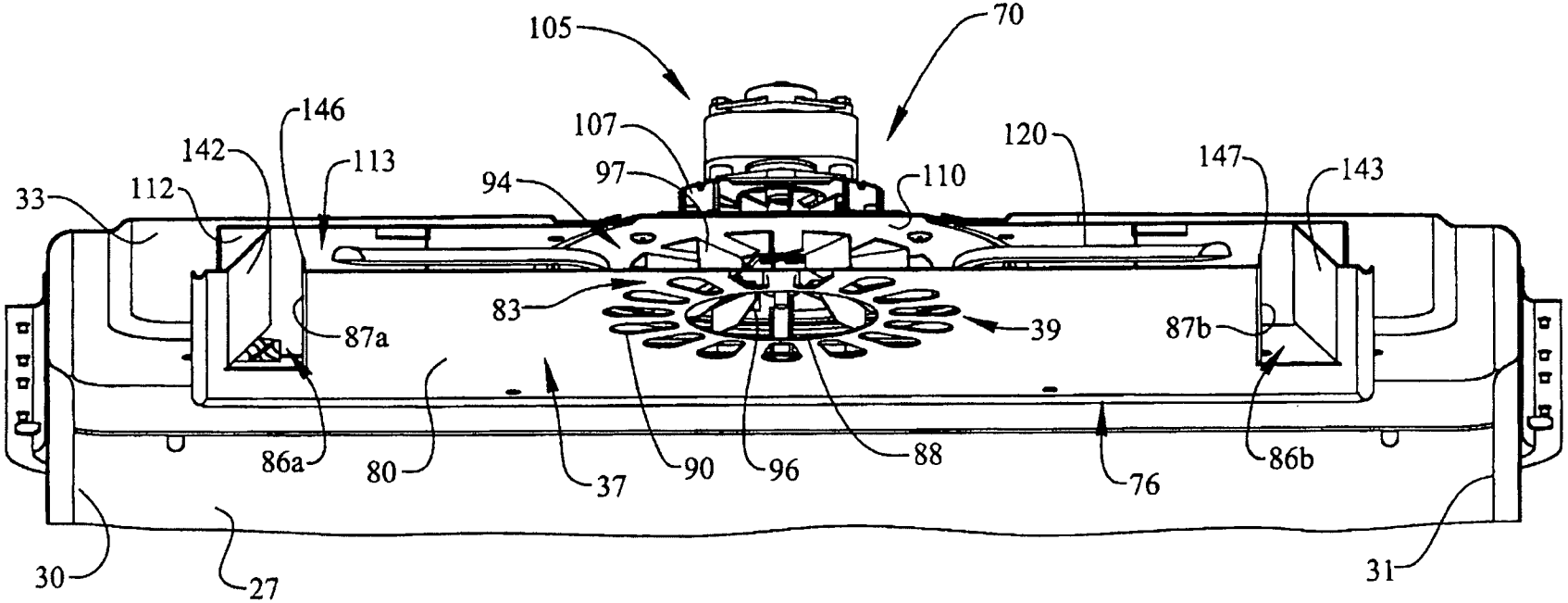
FIG. 2 is an upper cross-sectional view of a rear wall portion of the cooking appliance of FIG. 1 illustrating the airflow system constructed in accordance with the present invention.
Figure 3:
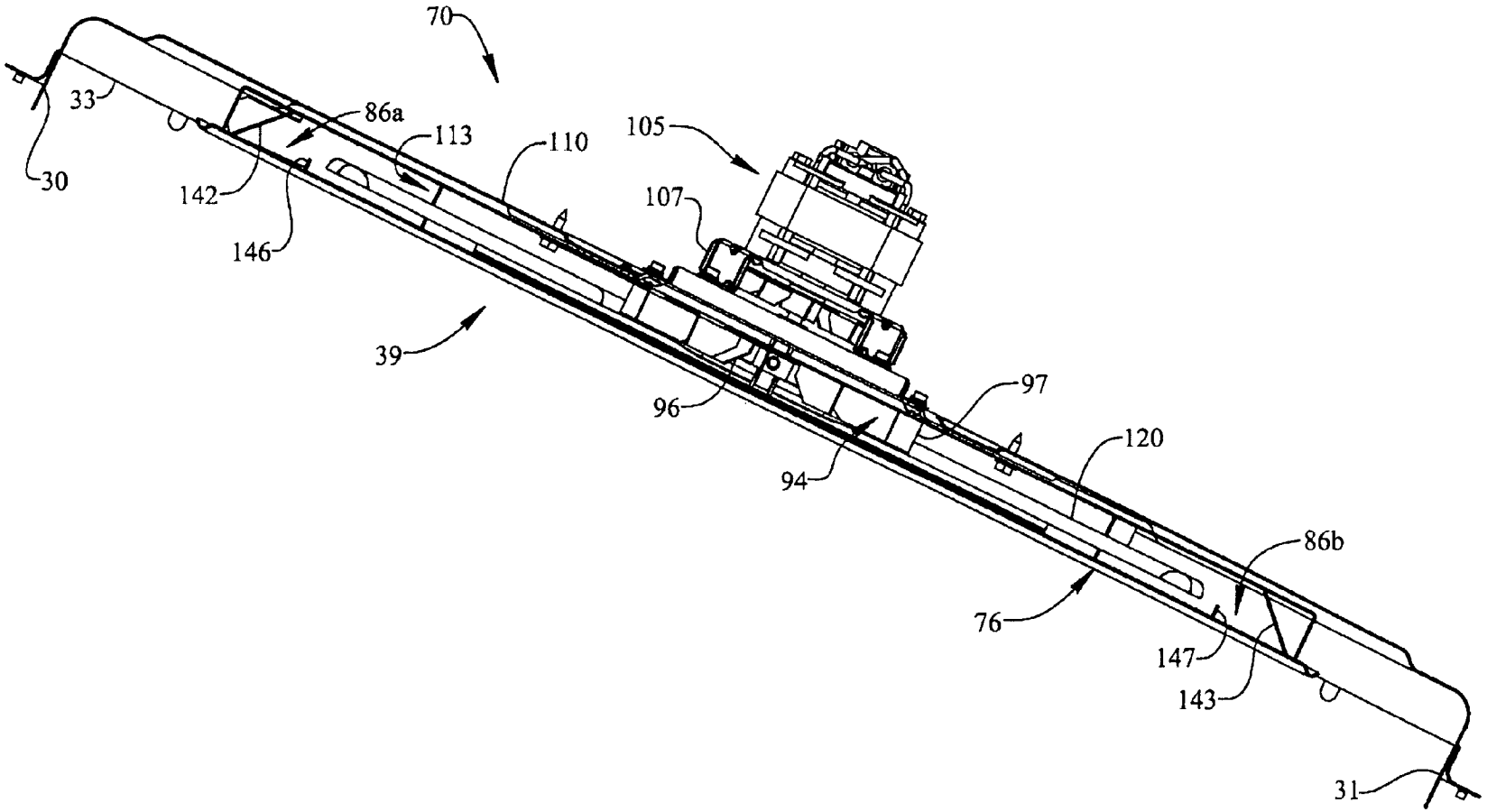
FIG. 3 is a cross-sectional side view of the rear wall of FIG. 2.

As best seen in FIGS. 2 and 3, airflow system 70 includes a convection fan cover 76 having a main body portion 80 provided with an inlet portion 83 arranged at central region 39 and a pair of outlet portions 86*a* and 86*b* that define corresponding openings 87*a*, 87*b* located behind vents 42 and 43, respectively. Preferably, convection fan cover 76 forms part of rear wall 33, however, convection fan cover 76 could also constitute a separate component. As shown, inlet portion 83 includes a first or central opening 88 about which are arranged a plurality of radially spaced apertures, one of which is indicated at 90. First opening 88 and apertures 90 are juxtaposed to a fan 94 which, in accordance with the invention, includes an innermost diametric portion 96 and an outermost diametric portion 97. Preferably, outermost diametric portion 97 of fan 94 is smaller than an overall diameter of the plurality of openings 90. This particular arrangement reduces airflow restrictions at inlet portion 83 increasing the overall airflow through airflow system 70. In any case, fan 94 is driven by a motor 105 mounted to a motor support 107 which is secured to a rear wall 110 of fan assembly 37. Actually, rear wall 110, a bottom wall 112 and opposing side and top walls (not shown) collectively define an overall airflow chamber 113. Airflow chamber 113 establishes a duct that, in combination with fan 94, defines an airflow circulation path for upper oven 4. In a manner which will be discussed more fully below, the airflow circulating within airflow chamber 113 and upper cooking chamber 6 is heated by a heating element 120 arranged substantially parallel to and downstream of fan 94. In the embodiment shown, heating element 120 takes the form of a sheathed, electric resistive heating element having an output of approximately 3300 watts. However, it should be understood that various other heating elements could also be employed.

In order to ensure that the airflow circulates properly within upper cooking chamber 6, airflow chamber 113 includes first and second angled louvers 142 and 143 arranged at outlet portions 86*a* and 86*b*, respectively. Actually, angle louvers 142 and 143 partially obstruct outlet openings 87*a*, 87*b*. That is, as best shown in FIG. 3, each angled louver 142 and 143 includes a first end (not separately labeled) that extends from a respective outlet portion 86*a*, 86*b* to a second end (not labeled) that is cantilevered over a respective opening 87*a*, 87*b*. In addition to angled louvers 142 and 143, airflow chamber 113 includes a pair of trip edge portions 146 and 147 that are arranged upstream of outlet portions 86*a* and 86*b* respectively. Angled louvers 142 and 143 cooperate with trip edge portions 146 and 147 to redirect the airflow generated by rotation of fan 94 by motor 105. That is, once the airflow impinges upon trip edge portions 146 and 147 and angled louvers 142 and 143, the direction of the airflow is altered from being generally parallel to fan 97 to being substantially perpendicular thereto. With this particular arrangement, the airflow will travel further away from fan 94 into upper cooking chamber 6 and improve cooking uniformity. More specifically, a turbulence is created in the airflow through the particular arrangement of angled louvers 142 and 143 and trip edge portions 146 and 147 and the airflow is effectively caused to flow forward adjacent the side walls 30 and 31 towards door 14 before being re-directed through a central zone in cooking chamber 6 for return to fan assembly 37 at central region 39. In this manner, temperature gradients from a rear portion of upper cooking chamber 6 to a front portion of upper cooking chamber 6 is substantially linear.

Figure 4:
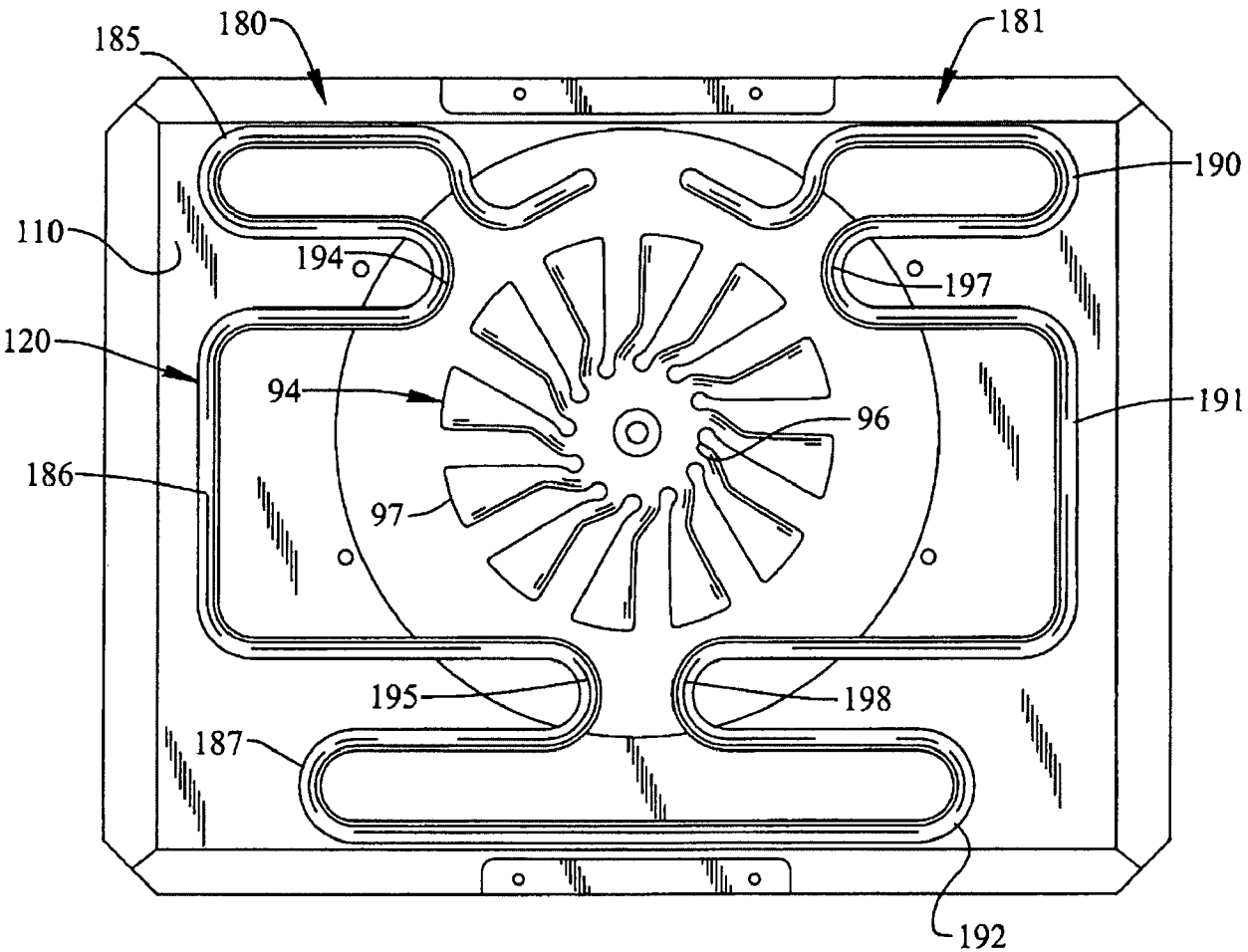
FIG. 4 is a plan view of a heating element and fan inlet portion of the airflow system constructed in accordance with the present invention.

In order to further improve airflow efficiency, as well as increase the overall heat transfer rate from heating element 120 to the airflow, heating element 120 is divided into first and second sections 180 and 181 arranged on either side of fan 94 as best shown in FIG. 4. Actually, first and second sections 180 and 181 are preferably arranged on either side of fan 94 so as to not extend across inlet portion 83. Each of first and second sections 180, 181 includes a plurality of lobes that extend parallel to and downstream of fan 94, adjacent outlet portions 86*a* and 86*b*. More specifically, each of first and second sections 180 and 181 includes a first plurality of out-turned lobes 185-187 and 190-192 respectively, as well as a plurality of in-turned lobes 194, 195 and 197, 198 respectively. As clearly shown, each lobe 185-187, 190-192, 194, 195, 197 and 198 defines a substantially 180° bend that establishes an overall serpentine path for heating element 120.

In accordance with the embodiment shown, first and second sections 180 and 181 are substantially coplanar. That is, first and second sections 180 and 181 lie substantially in the same plane so as to establish a thin profile heating element. Therefore, a thin profile heating element in accordance with the invention has all sections being substantially coplanar, thereby establishing a single wrap and minimizing any flow restrictions. However, while coplanar, each section 180, 181 travels a significantly different path. In accordance with other forms of the present invention, first and second sections can be arranged on multiple planes or, for that matter, lobes 185-187, 190-192, 194, 195, 197 and 198 can also be arranged in multiple planes. However, there is preferably no overlap of the heating element. By arranging heating element 120 in this particular manner, an unobstructed airflow path is established within airflow chamber 113. Moreover, this particular orientation for heating element 120 enables the use of a longer element that increases the total heat output without providing any significant obstructions to the airflow circulating through airflow chamber 113. With this overall arrangement, i.e., the combination of the angled louvers 142 and 143, trip edge portions 146 and 147 and the construction/orientation of heating element 120, an extremely efficient airflow path is established in upper cooking chamber 6. To this end, the present invention ensures that food items arranged within upper cooking chamber 6 are exposed to a uniform cooking temperature while, at the same time, heat transfer efficiencies are maximized from heating element 120 to the airflow in cooking appliance 2.

Although described with reference to a preferred embodiment of the invention, it should be readily understood that various changes and/or modifications can be made to the invention without departing from the spirit thereof. For instance, while described in connection with upper cooking chamber 6, the present invention could also be incorporated into lower cooking chamber 10. In general, the invention is only intended to be limited by the scope of the following claims.

We claim:

1. A cooking appliance comprising:

an oven cavity having top, bottom, rear, and opposing side walls that collectively define a cooking chamber;

a door mounted for movement relative to the oven cavity for selectively closing the cooking chamber;

a convection fan for establishing a convection airflow within the cooking chamber, said convection fan having an innermost diametric portion and an outermost diametric portion;

a heating element for raising a temperature of the convection airflow, said heating element including first and second sections symmetrically disposed about the convection fan substantially parallel to and downstream of the convection fan, each of said first and second sections having at least three lobes and four 180° turns, while establishing a thin profile heating unit; and a convection fan cover including a main body portion having an inlet portion for receiving the convection airflow from the cooking chamber and an outlet portion for directing the convection airflow back into the cooking chamber, said inlet portion being juxtapose the convection fan and including a plurality of apertures which extend radially outward beyond the outermost diametric portion of the convection fan, said outlet portion including an angled louver and a trip edge portion which cooperate to alter a direction of the convection airflow from being substantially parallel to the main body portion to being substantially perpendicular to the main body portion.

2. A cooking appliance comprising:

an oven cavity having top, bottom, rear, and opposing side walls that collectively define a cooking chamber;

a door mounted for movement relative to the oven cavity for selectively closing the cooking chamber;

a convection fan for establishing a convection airflow within the cooking chamber;

a heating element for raising a temperature of the convection airflow, said heating element including first and second sections symmetrically disposed about the convection fan substantially parallel to and downstream of the convection fan, each of said first and second sections having at least three lobes and four 180° turns, while establishing a thin profile heating unit; and a convection fan cover including a main body portion having an inlet portion for receiving the convection airflow from the cooking chamber and an outlet portion for directing the convection airflow back into the cooking chamber.

3. The cooking appliance according to claim 2, wherein the first and second sections of the heating element are substantially coplanar.

4. The cooking appliance according to claim 2, wherein the first section of the heating element includes first, second and third out-turned lobes each having at least one 180 degree bend.

5. The cooking appliance according to claim 4, wherein the first, second and third out-turned lobes are coplanar.

6. The cooking appliance according to claim 4, wherein the first section further includes first and second in-turned lobes each having at least one 180 degree bend.

7. The cooking appliance according to claim 6, wherein the first, second and third out-turned lobes, as well as the first and second in-turned lobes, are all coplanar.

8. The cooking appliance according to claim 2, wherein neither the first nor second sections of the heating element extend across the inlet portion of the convection fan cover.

9. The cooking appliance according to claim 2, wherein the convection cover forms part of the rear wall of the cooking chamber.

10. The cooking appliance according to claim 2, wherein the heating element is constituted by a sheathed, electric resistive element having a nominal heat output of approximately 3300 watts.

11. A cooking appliance comprising:

an oven cavity having top, bottom, rear, and opposing side walls that collectively define a cooking chamber;

a door mounted for movement relative to the oven cavity for selectively closing the cooking chamber;

a convection fan for establishing a convection airflow within the cooking chamber, said convection fan having an innermost diametric portion and an outermost diametric portion;

a heating element for raising a temperature of the convection airflow; and a convection fan cover including a main body portion having an inlet portion for receiving the convection airflow from the cooking chamber and an outlet portion for directing the convection airflow back into the cooking chamber, said outlet portion including an angled louver and a trip edge portion which cooperate to alter a direction of the convection airflow from being substantially parallel to the main body portion to being substantially perpendicular to the main body portion.

12. The cooking appliance according to claim 11, wherein the convection fan cover includes first and second outlet portions symmetrically disposed about the convection fan, each of said first and second outlet portions including a respective angled louver.

13. The cooking appliance according to claim 11, wherein the angled louver includes a first end that extends from the outlet portion to a second end that is cantilevered over, at least in part, the outlet portion.

14. The cooking appliance according to claim 12, wherein each of said first and second outlet portions includes a respective trip edge portion.

15. The cooking appliance according to claim 14, wherein the trip edge portion is constituted by an upstanding wall segment positioned adjacent the outlet portion in a path of the convection airflow.

16. The cooking appliance according to claim 11, wherein the convection fan includes an inner diametric portion and an outer diametric portion, said inlet portion including a plurality of apertures which extend radially outward beyond the outer diametric portion of the convection fan.

17. The cooking appliance according to claim 11, wherein the convection fan cover forms at least a portion of the rear wall of the cooking chamber.

* * * * *